US007958759B2

(12) United States Patent
Herdman

(10) Patent No.: US 7,958,759 B2
(45) Date of Patent: Jun. 14, 2011

(54) KEY-REMOVABLE LOCK CORE

(75) Inventor: Rodrick A. Herdman, West Chester, OH (US)

(73) Assignee: JaNaKa Limited Partnership, Mason, OH (US)

( * ) Notice: Subject to any disclaimer, the term of this patent is extended or adjusted under 35 U.S.C. 154(b) by 0 days.

(21) Appl. No.: 12/500,955

(22) Filed: Jul. 10, 2009

(65) Prior Publication Data

US 2010/0005842 A1 Jan. 14, 2010

Related U.S. Application Data

(60) Provisional application No. 61/079,471, filed on Jul. 10, 2008.

(51) Int. Cl.
*E05B 9/04* (2006.01)
*E05B 25/00* (2006.01)

(52) U.S. Cl. ..... 70/371; 70/338; 70/340; 70/383; 70/384; 70/386; 70/493

(58) Field of Classification Search ..... 70/382–386, 70/337–343, 493, 495, 378, 392, DIG. 44, 70/DIG. 71, DIG. 75, 358, 367–371, 419, 70/421

See application file for complete search history.

(56) References Cited

U.S. PATENT DOCUMENTS

| | | | | | |
|---|---|---|---|---|---|
| 3,206,958 | A * | 9/1965 | Best | 70/373 |
| 3,320,781 | A * | 5/1967 | Hill | 70/384 |
| 3,324,693 | A * | 6/1967 | Check | 70/369 |
| 3,589,153 | A * | 6/1971 | Hill | 70/384 |
| 4,424,693 | A * | 1/1984 | Best et al. | 70/369 |
| 4,836,002 | A * | 6/1989 | Monahan | 70/382 |
| 5,421,179 | A * | 6/1995 | Bergstrom | 70/369 |
| 6,382,006 | B1 * | 5/2002 | Field et al. | 70/371 |
| 6,526,791 | B2 * | 3/2003 | Shvarts | 70/419 |
| 6,981,396 | B1 * | 1/2006 | Kim | 70/495 |
| 7,051,562 | B2 * | 5/2006 | Evans et al. | 70/370 |
| 7,290,418 | B2 * | 11/2007 | Herdman | 70/383 |
| 7,533,550 | B2 * | 5/2009 | Herdman | 70/340 |
| 2006/0010945 | A1 * | 1/2006 | Herdman | 70/493 |
| 2006/0021406 | A1 * | 2/2006 | Herdman | 70/493 |
| 2009/0241620 | A1 * | 10/2009 | Field et al. | 70/360 |

* cited by examiner

*Primary Examiner* — Lloyd A Gall
(74) *Attorney, Agent, or Firm* — Hasse & Nesbitt LLC; Daniel F. Nesbitt

(57) ABSTRACT

A key-removable lock core that is retained in a core receptacle by a retaining lug, and which can operated by an operating key to align the pins of the pin chambers for shear at the operating shear line, and to allow the key plug to be rotated, and which employs a control tool with the operating key for manipulating the pins into alignment for shear at the control shear line, to allow the sleeve and the key plug together to be rotated, to move the retaining lug on the sleeve between a projected position in which the lug is engaged behind a rearward-facing shoulder in the core receptacle to retain the core in the receptacle, and a retracted position within the profile of the core.

9 Claims, 6 Drawing Sheets

KEY-REMOVABLE LOCK CORE

CROSS-REFERENCE TO RELATED APPLICATION

This application claims the benefit of U.S. Provisional Application No. 61/079,471, filed on Jul. 10, 2008, the disclosure of which is incorporated herein by reference in its entirety.

BACKGROUND OF THE INVENTION

This invention relates to a lock core that is manually removable by use of a key, for use in a lock cylinder, doorknob, or other core receptacle defining a core-receiving opening or chamber.

A key-removable lock core of the type shown, for example, in FIGS. 1-7 of Frank E. Best's U.S. Pat. No. 3,206,958 (the disclosure of which is incorporated herein by reference in its entirety) has been known since the 1920's and have been widely sold and used in a standard configuration and size so as to be readily interchangeable and renewable in the same lock mechanisms. Such standard lock core includes a core body of figure-8 cross section with body a key plug and a full-length thin-walled sleeve within its bottom lobe, the sleeve being rotatable through a limited angle to retract a core-retainer lug thereon. An axial series of pin tumbler barrels extend through the pin tumbler housing formed by the top lobe of the core body, through a thickened portion of the sleeve contained in a broached recess in such upper lobe, and into the key plug. This arrangement forms a full-length operating shear line at the interface between the key plug and the sleeve, and a full-length control shear line at the interface between the thickened portion of the sleeve and the upper lobe of the core body. An operating key will align the tumblers for shear at the operating shear line to allow the key plug to be rotated, while a control key will align the tumblers for shear at the control shear line to allow the sleeve and the key plug together to be rotated to move the retaining lug on the sleeve between a retracted position within the figure-8 profile of the core and a projected position in which such lug is engaged behind a rearward-facing shoulder in the core receptacle to retain the core in such receptacle.

Walter E. Best's et al. U.S. Pat. No. 4,424,693 (the disclosure of which is incorporated herein by reference in its entirety) shows another type of key-removable lock core for a lock chamber of figure-8 cross section having a short cylindrical key plug housing fitting the lower lobe of the chamber and a pin tumbler housing containing a series of pin tumbler barrels, two of which are in an extension beyond the key plug housing. A key plug is contained in such housing and a control sleeve aligned with such housing beneath the extension and having pin tumbler bores aligned with said two barrels. Side faces on the pin tumbler housing and spaced from the chamber side wall provide clearance on one side for a retaining lug on the control sleeve retractable into such clearance from core-retaining engagement behind a shoulder in the chamber, and clearance on the other side for a stop lug. An operating key aligns tumblers in all barrels for shear movement at an operating shear line at the outer surface of the key plug. A control key aligns tumblers in the two extension-contained barrels for shear movement at a control shear line at the outer surface of the control sleeve, and tumblers in the other barrels for shear movement at the operating shear line, to permit rotation of the sleeve to retract its retaining lug. The pin tumbler housing may have flat sides which define the lug clearances or may be cylindrical and have clearance recesses cut in it with end faces which ride against the lugs. The core may have a separate face plate, or the pin tumbler housing may itself form the front face of the core.

Peter H. Field's et al. U.S. Pat. No. 6,382,006 (the disclosure of which is incorporated herein by reference in its entirety) shows another type of key-removable lock core for a lock chamber of figure-8 cross section having an extended-length control key that engages a control tumbler, unreachable with the operating key. The control key engages the control tumbler across the operating shear line, while freeing movement of the sleeve at the control shear line.

In the above described key-removable lock cores, and other known and described conventional key-removable lock cores, an operating key aligns the tumblers for shear at the operating shear line to allow the key plug to be rotated, while a separate control key aligns the tumblers for shear at the control shear line, to allow the sleeve and the key plug together to be rotated to move the retaining lug on the sleeve between a retracted position within the figure-8 profile of the core and a projected position in which the lug is engaged behind a rearward-facing shoulder in the core receptacle to retain the core in the receptacle.

SUMMARY OF THE INVENTION

The present invention provides a key-removable lock core having a retaining lug that is retained in a core receptacle. The retaining lug is moveable between a projected position in which the lug is engaged behind a rearward-facing shoulder in the core receptacle to retain the core in the receptacle, and a retracted position within the profile of the core. The lock is operable by an operating key that aligns the pins of the pin chambers for shear at an operating shear line to allow the key plug to be rotated. A control tool is used with the operating key for manipulating the pins into alignment for shear at the control shear line, to allow the sleeve and the key plug together to be rotated, to move the retaining lug out of engagement with the core receptacle and to withdraw the key-removable lock core from the core receptacle.

The invention also provides a key-removable lock core that employs an auxiliary pin that is manipulated into the pin chamber that spans, causes another pin to span, the operating shear line, and raises the top of a control pin to a control shear line, to permit moving the retaining lug out of engagement with the core receptacle, and removing of the key-removable lock core from the core receptacle.

The present invention relates, in a key-removable lock core, to a cylindrical key plug that further has at least one control cavity disposed in the periphery, displaced circumferentially from one of the tumbler chambers, a control channel intersecting at least a portion of the control cavity, an auxiliary control pin disposed in the control cavity, and biased outwardly from the opening of the control cavity in response to manipulation of a control tool in the control channel to intersect the control cavity.

The invention provides a key-removable lock core that employs an auxiliary pin that is manipulated into the pin chamber to span an operating shear line, and to raise the top of an associated control pin to a control shear line, to allow movement of a retaining lug out of engagement with a core receptacle that permits removal of the key-removable lock core from the core receptacle.

The present invention also relates to a key-removable lock core comprising: a) a sleeve comprising a lower cylindrical barrel portion having a longitudinally arranged tubular bore, an upper extension having a plurality of spaced-apart radially-arranged operating pin bores, and a retaining lug extending from the sleeve; b) a housing having (i) a lower body portion having a longitudinally-arranged tubular bore for receiving the barrel portion of the sleeve, (ii) an upper body portion having a longitudinally-arranged retaining chamber for receiving the upper extension and retaining lug of the sleeve, and a plurality of radially-arranged control pin bores extending to the tubular bore to define a control shear line, and (iii) a retaining slot to accommodate tangential movement there through of the retaining lug; c) a cylindrical key plug rotatable between a key insertion position and a control position, within the tubular bore of the sleeve, and having a cylindrical periphery, a longitudinally-arranged keyway, a plurality of radially-arranged tumbler bores that extend from the keyway to the periphery, to define an operating shear line, the key plug further having at least one control cavity displaced radially from at least one of the tumbler bores, and a control channel intersecting a portion of the at least one control cavity; d) a plurality of tumbler pins disposed for axial movement within the plurality of tumbler bores; e) a plurality of operating pins disposed for axial movement within the plurality of operating pin bores; f) a plurality of control pins disposed for axial movement within the plurality of control pin bores; g) at least one auxiliary control pin disposed in the at least one control cavity; and h) a control tooling configured for manipulation within the control channel to intersect the at least one control cavity, for biasing the at least one auxiliary control pin out of the at least one control cavity at least partially into an associated tubular bore in the sleeve when the key plug is disposed in the sleeve in the control position.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF EMBODIMENTS OF THE INVENTION

Figure 1:
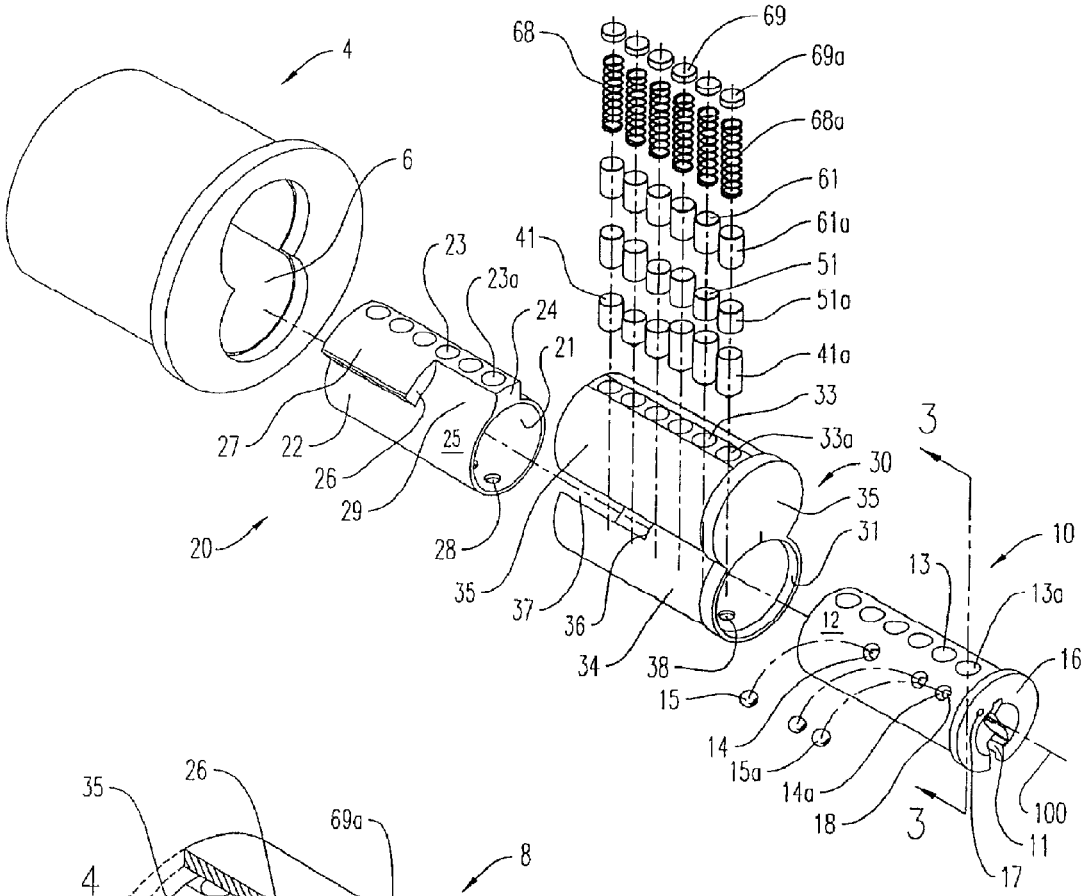
FIG. 1 shows a perspective, exploded view of an embodiment of a key-removable lock core of the present invention.
Figure 2:
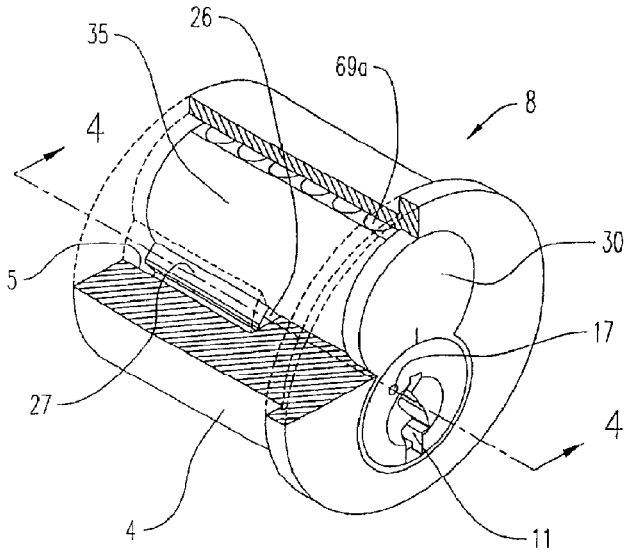
FIG. 2 shows a perspective, assembled view of the same key-removable lock core, disposed within a core receptacle shown in partial sectional view.

A first embodiment of a key-removable lock core assembly of the present invention is shown in FIGS. 1 through 6. This embodiment shows a key-removable lock core having a full-length cylindrical key plug disposed within the sleeve and housing, and a separate control tool for manipulating the control pin or pins.

Like reference numerals designate like elements throughout the several views.

The key-removable lock core comprises a sleeve 20 comprising a lower cylindrical barrel portion 22 having a longitudinally arranged tubular bore 21 centered on centerline 100 for receiving a cylindrical key plug 10, and comprising on its upper side an extension 24 having a plurality of operating pin bores 23 extending circumferentially from and spaced apart along the centerline 100. The sleeve 20 has a retaining lug 27 extending radially from a rear portion of the sleeve 20, and integrally and tangentially from the sleeve extension 24 to define a retaining lug profile in cross section. The retaining lug 27 has a forward-facing lug face 26 that defines a recess 29 forward of the retaining lug 27.

The key-removable lock core also comprises a housing 30 having a lower barrel portion 34 having a longitudinally arranged tubular bore 31 centered on centerline 100 for receiving the barrel portion 22 of the sleeve 20, and an upper portion 35, also shown as having a cylindrical shaft, having a plurality of control pin bores 33 extending radially from and spaced apart along the centerline 100, and that register with the operating pins bores 23. Thus, the control pins 33 align with the corresponding operating pins 23 of the sleeve 20, with their respective centerlines passing through the centerline axis 100 of the key-removable core lock. The upper portion 35 also has a longitudinally-arranged retaining chamber 39 for receiving and accommodating tangential movement of the retaining lug 27, as well as the extension 24, of the sleeve 20. A portion of the housing 30 is removed proximate a rearward portion of the interface of the lower barrel portion 34 and the upper barrel portion 35 to form a retaining slot 37 having a rearward-facing shoulder 36.

Figure 17:
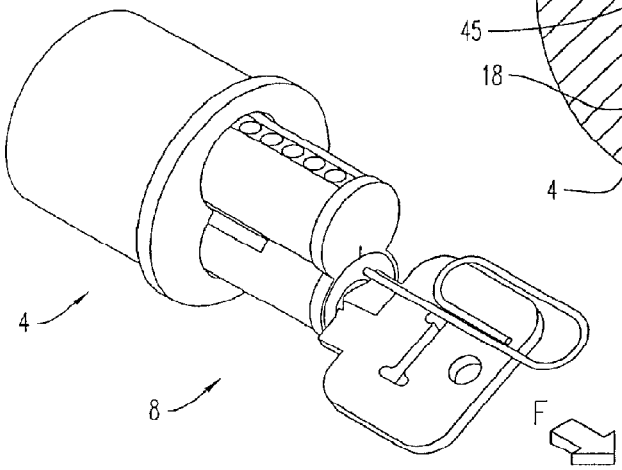
FIG. 17 shows the key-removable lock core of FIG. 15 partially withdrawn from the core receptacle.

The sleeve 20 and housing 30 cooperate for partial rotational movement of the sleeve within the housing around centerline 100, between a first position and a second position. In the first or retained position, shown in FIGS. 2 and 5, the retaining lug 27 extends through and beyond the retaining slot 37, where the retaining lug 27 can engage a complementary recess 5 in the inner surface 6 of the core receptacle 4. In the second or removal position, the retaining lug 27 of the sleeve 20, as well as the extension 24, are disposed within the upper bore 39 of the housing 30, and fully within the cross-sectional Figure-8 profile of the housing 30, thereby allowing axial movement and removal of the key-removable lock core 8 from the core receptacle 4, as shown in FIG. 17.

The key-removable lock core also comprises a key plug 10 having a cylindrical periphery 12 for rotation within the bore 21 of the sleeve 20, a radial flange 16 at its front end, a keyway 11 extending axially throughout its length, and a plurality of tumbler bores 13 that are formed to extend into the keyway 11, and that extend radially from and are spaced apart along the centerline 100. The tumbler bores 13 align with the operating pin bores 23 and the control pin bore 33 to form pin chambers.

Figure 4:
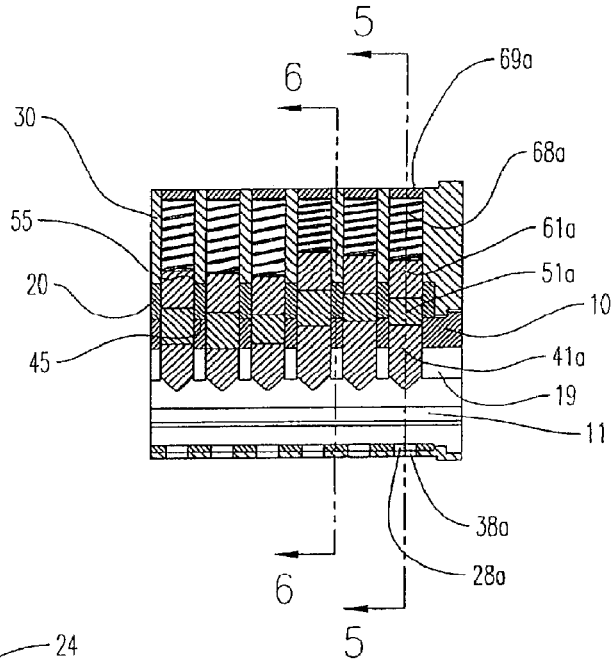
FIG. 4 shows a longitudinal sectional view of the key-removable lock core through line 4-4 of FIG. 2.

In the illustrated embodiment, the key plug 10 also has at least one control cavity, and more typically a plurality of control cavities 14, formed into the outer surface 12 of the key plug, to accommodate an at least one auxiliary control pin 15, and more typically a plurality of auxiliary control pins 15, which are illustrated as spherical auxiliary control balls. The auxiliary control pin can be other shapes within the control cavity, including a barrel, a cylinder, a cube, and a rectangle. Though three control cavities are shown, and all three of the control cavities shown have an associated auxiliary control pin 15, any number of control cavities can be used, and any one of the control cavities may have an associated auxiliary control pin 15. The control cavity 14 has sidewalls and a bottom, and retains the auxiliary control pin 15 wholly within the control cavity 14 unless biased outwardly through the opening at the plug periphery 12 by a control tooling, as described herein after. Each control cavity is associated with and displaced radially from one of the tumbler bores. The control cavity is typically displaced about 15 to about 60 degrees, right or left, from the tumbler bores. In FIGS. 1 and 4 it can be seen that control cavity 14*a* and its associated auxiliary control pin 15*a* are associated with pin chamber "a", which is the first chamber inboard from the front end of the key-removable lock core. Likewise, pin chamber "b" would be the second pin chamber inboard from the front end, etc. U.S. Pat. Nos. 7,533,550, 7,290,418, and US Patent Publication 2006-0010945 (the disclosures of which are incorporated herein by reference in their entirety) disclose rekeyable locks employing one or more retainer cavities and one or more change members associated therewith whose positioning within the retainer cavity can effect the lock configuration to operate with one of a set of user keys.

Figure 3:
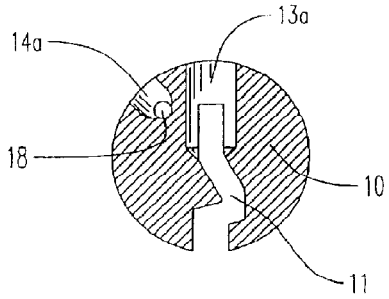
FIG. 3 shows a transverse sectional view of the key plug through line 3-3 of FIG. 1.

The key plug 10 also has a control channel 18 which intersects each of the plurality of control cavities 14. The control channel 18 is shown extending parallel to the longitudinal axis 100 of the key plug 10, and as shown in FIG. 3, passes through the lower portion of each control cavity 14. In the illustrated embodiment, the control channel 18 is shown extending forward through the front of the plug face to form aperture 17, though an embodiment employing a rear-inserted tooling can obviate such aperture in the front face. The control channel is also shown extending only to the last control cavity 14*d*, but can extend further toward and through the rear face of the key plug 10. The control channel 18 is shown having a circular cross section, though a curvilinear or rectilinear slot can also be used.

The control channel 18 typically accommodates for manipulation therein a similarly shaped control tooling. In the illustrated embodiment, the control tooling is a control tool 95 having an elongated cylindrical shaft 96. As suggested by FIG. 12, the control tooling can be a standard-sized paper clip. In alternative embodiments, the control tooling can have a beveled end 97 that allows the tooling to leverage under auxiliary control pins of all shapes, including barrels and disks.

Figure 13:
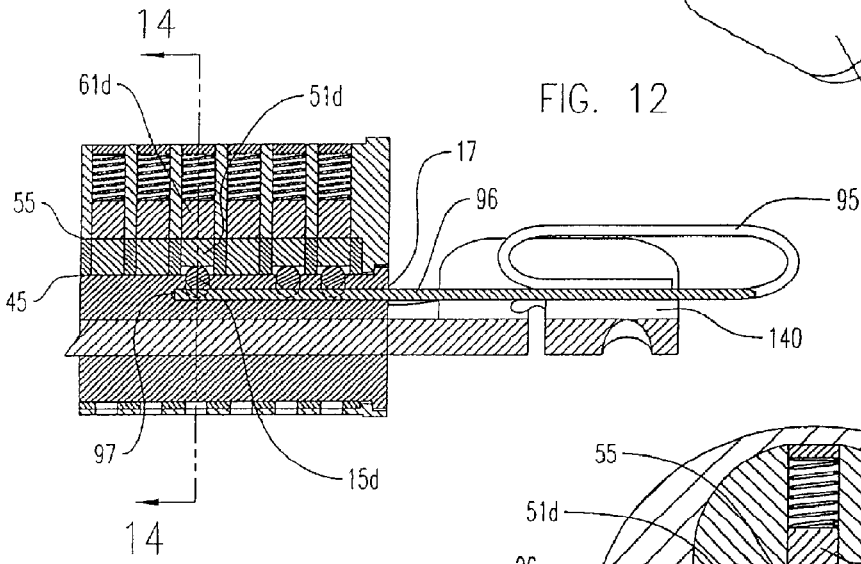
FIG. 13 shows a longitudinal sectional view of the key-removable lock core through line 13-13 of FIG. 12.
Figure 14:
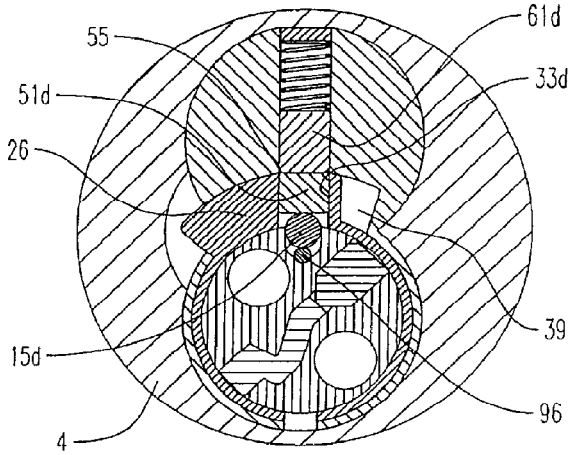
FIG. 14 shows a transverse sectional view of the key-removable lock core through line 14-14 of FIG. 13.

As illustrated in FIGS. 13 and 14, the control channel 18 and control tooling 95 are disposed and sized so that manipulation of the control tooling 95 within the control channel 18 causes the shaft 96 of the control tooling 95 to intersect the bottom of each control cavity 14, raising the auxiliary control pin 15 only partially out of the opening of the control cavity 14. More particularly, the outermost surface of the auxiliary control pin 15 is raised a control height amount out from the outer periphery 12 of the key plug 10, and typically is not raised wherein the center point of the spherical auxiliary control ball passes beyond said outermost surface, which might incidentally result in the ball being moved into the operating pin bore 23. In the illustrated embodiment, it is intended that the auxiliary control pin 15 does not completely leave the control cavity 14. Consequently, manipulation of the change tooling 95 within the control channel 18 raises the auxiliary control pin 15 only partially within the control cavity 14, and only partially out through the opening in the periphery 12.

Associated with one or more of the pin chambers are a plurality of tumbler pins 41. The tumbler pin 41 is generally the same cross section as the tumbler bore 13, typically circular, and is sized to almost the diameter or cross-sectional dimension of the tumbler bore to allow essentially frictionless axial movement within the tumbler bore. Though not clearly illustrated but as well known in the art, the tumbler bore 13 has a chamfer within the keyway 11 which prevents the tumblers 41 from dropping completely down into the keyway 11.

Also associated with one or more of the pin chambers is an operating pin 51. The operating pin 51 is generally the same cross section as the operating pin bore 23, typically circular, and is sized to almost the diameter or cross-sectional dimension of the operating pin bore to allow essentially frictionless axial movement within the operating pin bore. The lower face or surface of the operating pin 51 interfaces with the upper face or surface of the tumbler pin 41, which two faces can be separated tangentially when the interface is positioned at the operating shear line 45 formed between the outer periphery 12 of the cylindrical key plug 10 and the inner cylindrical surface of the sleeve bore 21.

Figure 5:
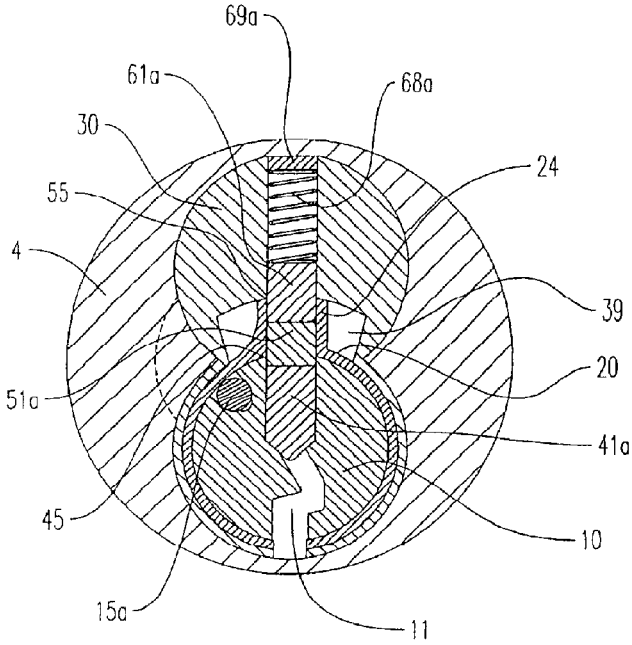
FIG. 5 shows a transverse sectional view of the key-removable lock core through line 5-5 of FIG. 4.
Figure 6:
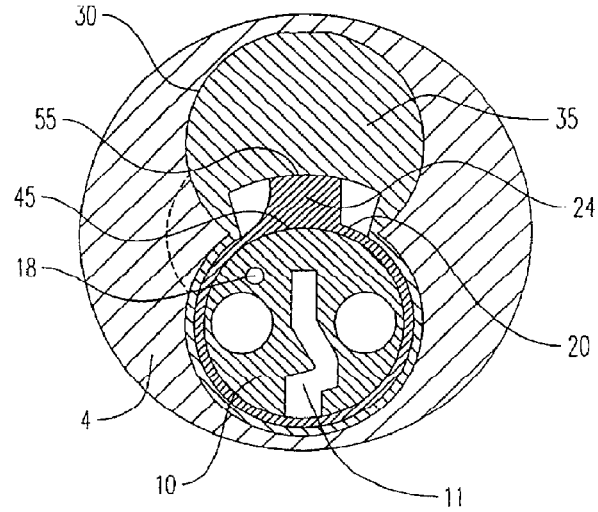
FIG. 6 shows a second transverse sectional view of the key-removable lock core through line 6-6 of FIG. 4.

Additionally associated with one or more of the pin chambers is a control pin 61. The control pin 61 is generally the same cross section as the control pin bore 33, and is typically circular, and is sized to almost the diameter or cross-sectional dimension of the control pin bore to allow essentially frictionless axial movement within the control pin bore. The lower face or surface of the control pin 61 interfaces with the upper face or surface of the operating pin 51, which two faces can be separated tangentially when the interface is positioned at the control shear line 55 formed between the top surface of the sleeve extension 24 of the sleeve 20 and the upper, inner surface of the retaining chamber 39 of the housing 30, which is shown in FIG. 5. As previously described, manipulation of the control tooling 95 within the control channel 18 raises the auxiliary control pin 15 only partially within the control cavity 14, and raises the associated tumbler pin 41, operating pin 51 and control pin 61 by the control height amount above the shear line 45.

In FIGS. 1 and 4 it can be seen that tumbler 41*a*, operating pin 51*a* and control pin 61*a* are associated with pin chamber "a", and so forth. A plug 69 is friction forced into the top opening of the control pin bore 33 to retain a biasing member shown as biasing spring 68, which biases the tumbler 41, operating pin 51 and control pin 61 within the pin chamber toward the keyway 11.

Figure 7:
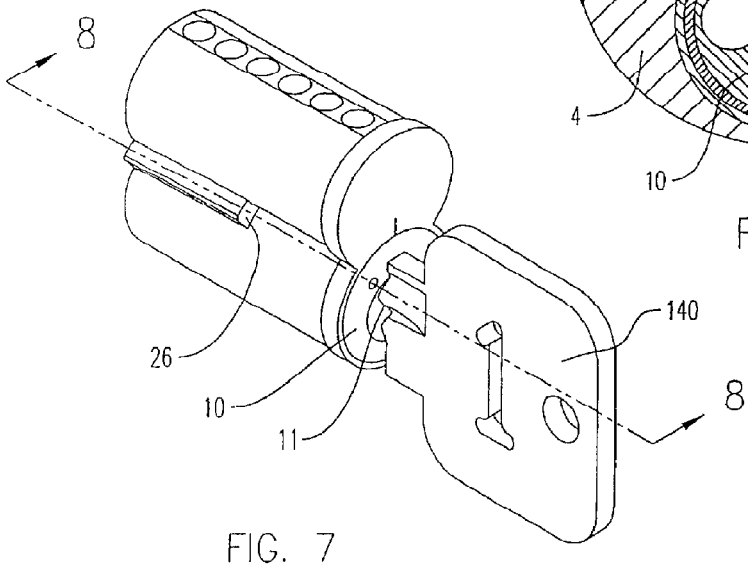
FIG. 7 shows a perspective view of the key-removable lock core having an operating key inserted in the keyway.
Figure 8:
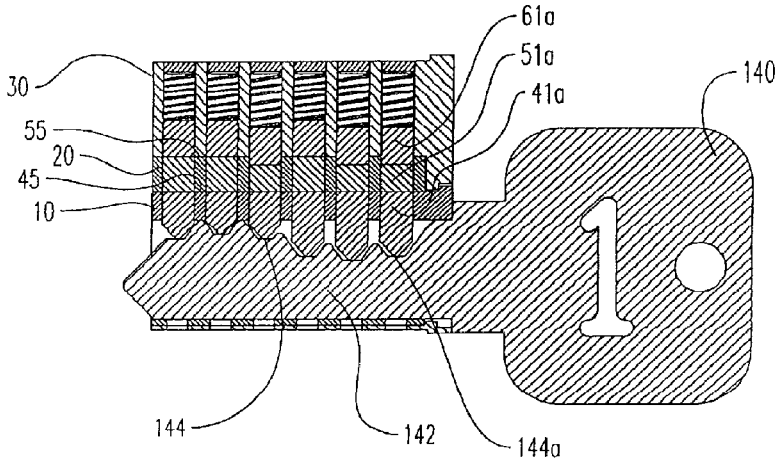
FIG. 8 shows a longitudinal sectional view of the key-removable lock core through line 8-8 of FIG. 7.

Operation of the key-removable lock core is illustrated in FIGS. 7-17. An operating key 140 is shown inserted into the keyway 11. The operating key 140 has a blade portion 142 having sidewalls with a profile that conform to the sidewall profile of the keyway 11, and a top contour 144 having contour positions 144*a*, 144*b*, and so forth, that register with pin chambers "a", "b", and so forth. When fully inserted into the keyway 11 of the key-removable lock core as shown in FIGS. 7 and 8, each contour position raises the plurality of pins within the respective pin chamber by a height according to the height of the cut of said contour position. The operating key 140 raises the top end of each tumbler pin 41 to the operating shear line 45, which allows tangential separation from the bottom end of the control pin 51, and for the key plug 10 to rotate within the sleeve 20. At the same time, the top ends of the plurality of operating pins 51 are not all raised to the control shear line 55; rather, three of the operating pins 51, including operating pin 51*a*, span across the control shear line 55 and lie partly within the operating pin bore 23 and the control pin bore 33, thereby preventing relative rotation of the sleeve 20 within the housing 30. Consequently, use of the operating key 140 per se allows the plug to be freely rotated within the sleeve 20 to lock and unlock the associated latch or bolt with which the key-removable lock core is associated, but does not effect rotation of the sleeve within the housing.

Figure 9:
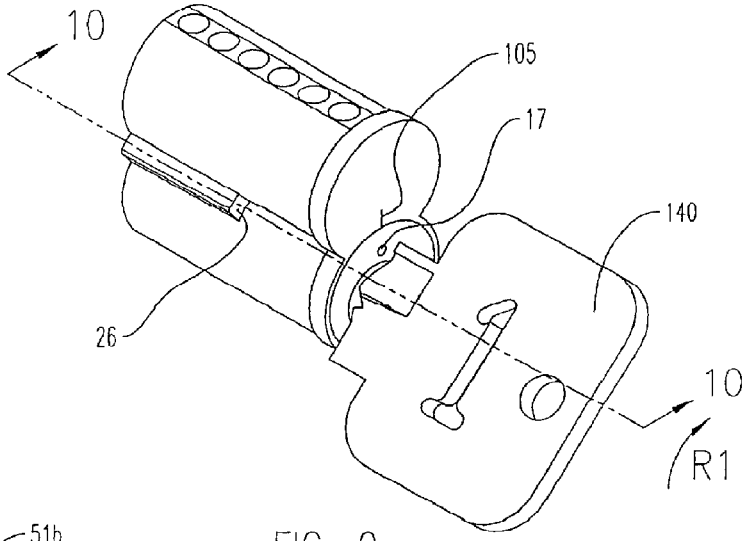
FIG. 9 shows the key-removable lock core with the key plug rotated by the operating key to a first position.
Figure 10:
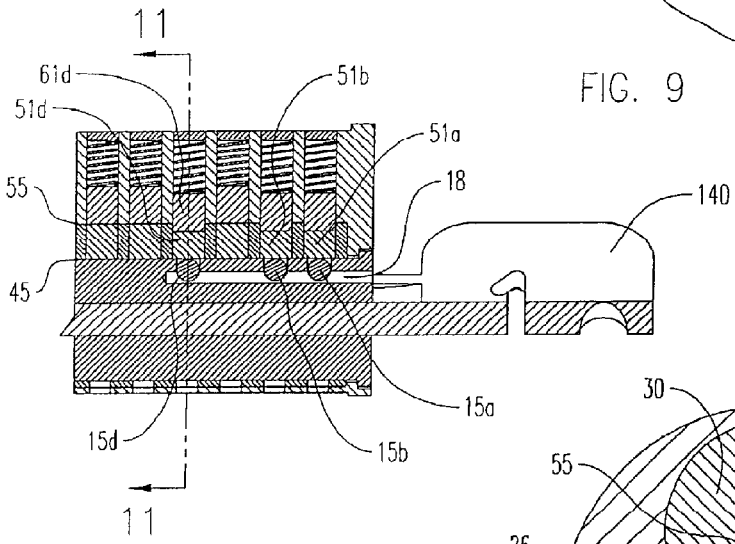
FIG. 10 shows a longitudinal sectional view of the key-removable lock core through line 10-10 of FIG. 9.
Figure 11:
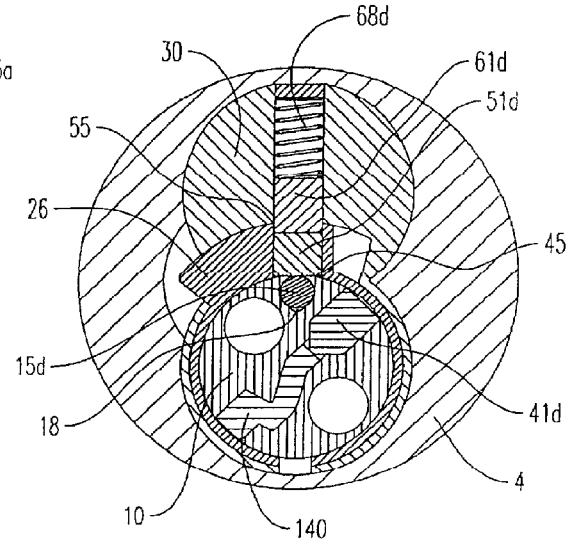
FIG. 11 shows a transverse sectional view of the key-removable lock core through line 11-11 of FIG. 10.

In FIGS. 9-11, the key plug 10 is rotated into a position for effecting alignment of the respective operating pins and control pins along the control shear line 55. The key plug 10 is shown rotated by the operating key 140 to a first rotated position, R1, wherein the control channel 18 and its associated aperture 17 is aligned with the operating pin bores and the control pin bores comprising the pin chambers. A mark 105 can be made on the front face of the housing 30 to signal the proper positioning of the key plug 10 within the sleeve 20. Other visual, audible or tactile means well known in the art for signaling a position of the plug within the sleeve and/or housing can be employed. In this position, the plurality of operating pins 51 rest at the shear line 45, with operating pins 51*a*, 51*b* and 51*d* that are positioned above auxiliary control pins 15*a*, 15*b* and 15*d* disposed within respective control cavities 14*a*, 14*b* and 14*d*. The control shear line 55 remains spanned by control pins 61*a*, 61*b* and 61*d*, preventing rotation of the sleeve 20 within the housing 30 about centerline axis 100.

Figure 12:
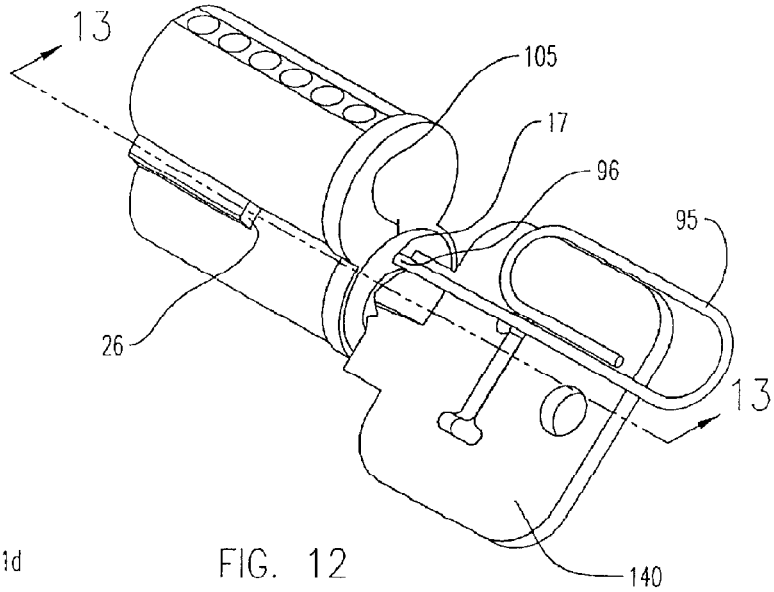
FIG. 12 shows manipulation of a control tool within a control channel for manipulating the control pins.

In FIGS. 12-14, the key-removable lock core is manipulated with a control tooling to enable the sleeve 20 to rotate in the housing 30 about the centerline 100 and along the control shear line 55. A control tooling member 95, shown as a paper clip, is adapted to provide an elongated shaft 96, which is inserted by hand through the opening 17 and into the control channel 18. Manipulation of the shaft 96 into the control channel 18 causes each of the auxiliary control pins 15 to be forced off of the bottom of the control cavity 15 and partially out through the opening of the control cavity. In particular, the three auxiliary control pins are raised partially within the respective control cavities 15, and correspondingly raise each of the operating tumblers 51*a*, 51*b* and 51*d* a control height amount above the shear line 45. In doing so, the top edges of each of the operating pins 51*a*, 51*b* and 51*d* is raised to the control shear line 55, whereby none of the operating pins span across the control shear line 55, allowing rotation of the sleeve within the housing. At the same time, a portion of each of the auxiliary control pins 15*a*, 15*b* and 15*d* spans the operating shear line 45.

Figure 15:
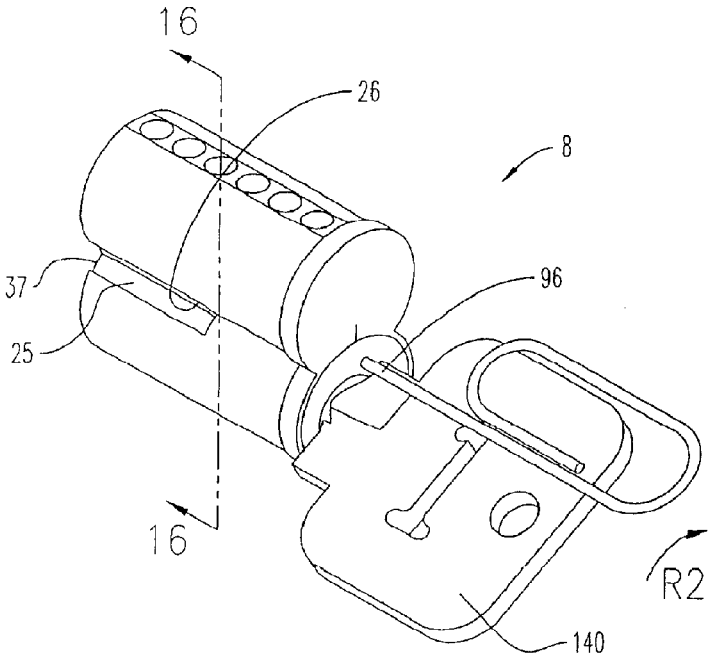
FIG. 15 shows the key-removable lock core of FIG. 12 with the key plug rotated by the operating key to a second position for retracting the retaining lug into the profile of the housing.
Figure 16:
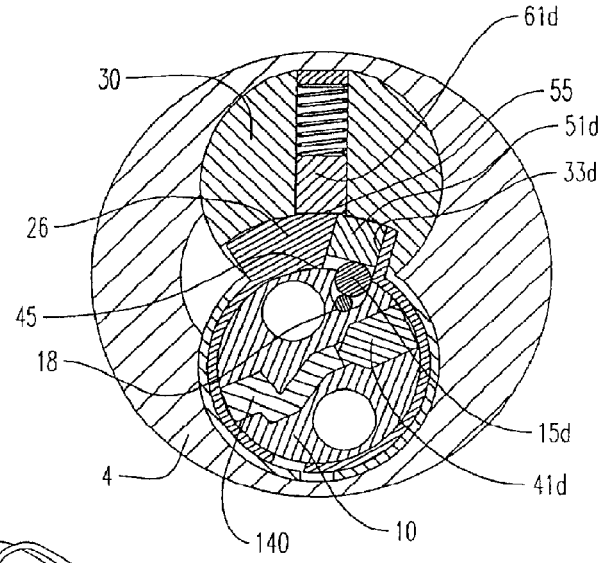
FIG. 16 shows a transverse sectional view of the key-removable lock core taken through line 16-16 in FIG. 15.

In FIGS. 15-17, the sleeve 20 has been rotated further clockwise to rotate the sleeve 20 to rotate within the housing 30, to a second removal position, R2, where the retaining lug has been moved from behind a rearward-facing shoulder in the core receptacle, to a retracted position shown in FIG. 16 which lies within the figure-8 profile of the housing 30. From this rotation position, the key-removable lock core assembly 8 can be withdrawn from the core receptacle 4 by axial pulling on the user key 140, effecting axial movement and removal of the key-removable lock core 8 from the core receptacle 4, as shown in FIG. 17. The key plug 10 had rotated only slightly within the sleeve 20 before further relative rotation was prevented by the auxiliary control pins 15*a*, 15*b* and 15*d* which had spanned the operating shear line 45.

A second key-removable lock core assembly, along with its respective operating key having a different contour, can be inserted into the core receptacle 4 in place of the removed key-removable lock core assembly 8.

Various alternative embodiments of the present invention can be made without departing from the essential features of the invention.

In an alternative embodiment, the retaining lug can be disposed on the forward portion of the sleeve, or along the entire length of the sleeve, provided that the core receptacle has a forwardly disposed shoulder or member that blocks axial forward movement of the retaining lug in its projected position.

In another alternative embodiment of the present invention, the control cavities 14 and associated auxiliary control pins 15 and control cavity 18 can be disposed on the opposed side of the keyway 11 of the key plug 10, whereby rotation of the plug to the first and second positions from the key insertion position is in the counter-clockwise direction.

In a further alternative embodiment, master pins and a master keying system can be used with the key-removable lock core, as is well known in the lock field, by placing master shims or pins between each of the tumbler pins 41 and operating pins 51.

In another embodiment of the present invention, the plurality of auxiliary control pins can be formed integrally into an auxiliary control pin assembly, comprising at least two auxiliary control pins secured to an elongated base that communicates with the control tooling within the control channel to raise the auxiliary control pins.

In an alternative embodiment of the key-removable lock core, an integral control tooling can be employed which is disposed within the key plug 10 in a first position, and is biased or manipulated to a second position within the control channel to intersect the change tooling with the control cavities. An example of an integral control tooling is shown in U.S. patent application Ser. No. 11/374,299, the disclosure of which is incorporated by reference in its entirety, which can be configured to raise the center point of a control pin ball to not beyond the periphery of the key plug.

The embodiments of a key-removable lock core assembly can be used in a variety of locking devices. These locking devices include both commercial and residential locks, and include by example, knob locks, deadbolt locks, and even padlocks.

An alternative embodiment is based on a key-removable lock core as described in U.S. Pat. No. 4,424,693, issued to Best et al, the disclosure of which is incorporated by reference in its entirety, in which the control cavity or cavities are associated with either or both of the pin chambers associated with the control sleeve described therein.

While the invention has been disclosed by reference to the details of preferred embodiments of the invention, it is to be understood that the disclosure is intended in an illustrative rather than in a limiting sense, as it is contemplated that modifications will readily occur to those skilled in the art, within the spirit of the invention and the scope of the appended claims.

What is claimed is:

1. A key-removable lock core comprising:

a) a sleeve comprising a lower cylindrical barrel portion having a longitudinally arranged tubular bore, an upper extension having a plurality of spaced-apart radially-arranged operating pin bores, and a retaining lug extending from the sleeve;

b) a housing having (i) a lower body portion having a longitudinally-arranged tubular bore for receiving the barrel portion of the sleeve, (ii) an upper body portion having a longitudinally-arranged retaining chamber for receiving the upper extension and retaining lug of the sleeve, and a plurality of radially-arranged control pin bores extending to the tubular bore to define a control shear line, and (iii) a retaining slot to accommodate tangential movement there through of the retaining lug;

c) a cylindrical key plug rotatable between a key insertion position and a control position, within the tubular bore of the sleeve, and having a cylindrical periphery, a longitudinally-arranged keyway, a plurality of radially-arranged tumbler bores that extend from the keyway to the periphery, to define an operating shear line, the key plug further having at least one control cavity displaced circumferentially from at least one of the tumbler bores, and a control channel intersecting a portion of the at least one control cavity;

d) a plurality of tumbler pins disposed for axial movement within the plurality of tumbler bores;

e) a plurality of operating pins disposed for axial movement within the plurality of operating pin bores;

f) a plurality of control pins disposed for axial movement within the plurality of control pin bores;

g) at least one auxiliary control pin disposed in the at least one control cavity; and h) a control tooling configured for manipulation within the control channel to intersect the at least one control cavity, for biasing the at least one auxiliary control pin out of the at least one control cavity at least partially into an associated tubular bore in the sleeve when the key plug is disposed in the sleeve in the control position.

2. The key-removable lock core according to claim 1 wherein the retaining lug has a forward-facing lug face and the retaining slot of the housing has a rearward-facing shoulder for engaging the forward-facing lug face.

3. The key-removable lock core according to claim 1 wherein the at least one control cavity is a plurality of control cavities.

4. The key-removable lock core according to claim 1 wherein the control channel extends forward through a front face of the key plug.

5. The key-removable lock core according to claim 1 wherein the at least one auxiliary control pin is a ball.

6. The key-removable lock core according to claim 1 wherein the control tooling comprises an elongated shaft.

7. The key-removable lock core according to claim 1 wherein the control tooling biases the at least one auxiliary control pin only partially into the associated tubular bore.

8. The key-removable lock core according to claim 1 wherein the control tooling is an integral control tooling disposed within the key plug for movement between a first position and a second position in which it intersects the at least one control cavity.

9. A key-removable lock core comprising a sleeve that has a plurality of pin chambers and includes a retaining lug and a key plug having a plurality of tumbler chambers, at least one control cavity having an opening disposed in a periphery of the key plug, displaced circumferentially from one of the plurality of tumbler chambers, a control channel intersecting at least a portion of the at least one control cavity, and including an auxiliary control pin disposed in the at least one control cavity, the sleeve being moveable between a projected position in which the retaining lug is engaged behind a rearward-facing shoulder in a core receptacle to retain the lock core in the core receptacle, and a retracted position in which the retaining lug is within the profile of the lock core and out of engagement with a recess in the core receptacle, the lock core being operable by rotating of the key plug within the sleeve with an operating key that aligns a plurality of operating pins in the plurality of pin chambers for shear at an operating shear line to allow the key plug to be rotated, the operating key being used with a control tool manipulated within the control channel to move the auxiliary control pin out of the at least one control cavity for manipulating a plurality of control pins into alignment for shear at a control shear line, to allow the sleeve and the key plug together to be rotated to the retracted position of the sleeve, to move the retaining lug out of engagement with the core receptacle and to withdraw the key-removable lock core from the core receptacle.

* * * * *